US010940684B2

(12) United States Patent
Fisher et al.

(10) Patent No.: US 10,940,684 B2
(45) Date of Patent: Mar. 9, 2021

(54) ROLLER ASSEMBLY FOR HEAT TRANSFER PRINTING SYSTEM OR HOT STAMP FOIL APPLICATION SYSTEM

(71) Applicant: Illinois Tool Works Inc., Glenview, IL (US)

(72) Inventors: Joseph Michael Fisher, Cheektowaga, NY (US); Timothy Spencer Burt, Lancaster, NY (US); Brenda Lee Denny, Caneadea, NY (US)

(73) Assignee: Illinois Tool Works Inc., Glenview, IL (US)

( * ) Notice: Subject to any disclaimer, the term of this patent is extended or adjusted under 35 U.S.C. 154(b) by 175 days.

(21) Appl. No.: 16/178,245

(22) Filed: Nov. 1, 2018

(65) Prior Publication Data

US 2019/0193388 A1 Jun. 27, 2019

Related U.S. Application Data

(60) Provisional application No. 62/610,687, filed on Dec. 27, 2017.

(51) Int. Cl.

| | |
|---|---|
| ***B41F 16/00*** | (2006.01) |
| *B41J 2/315* | (2006.01) |
| *B41F 30/00* | (2006.01) |

(52) U.S. Cl.

CPC ..... *B41F 16/00* (2013.01); *B41F 16/006* (2013.01); *B41F 16/0026* (2013.01); *B41F 30/00* (2013.01); *B41J 2/315* (2013.01)

(58) Field of Classification Search

None

See application file for complete search history.

(56) References Cited

U.S. PATENT DOCUMENTS

| | | | | |
|---|---|---|---|---|
| 2,749,133 | A * | 6/1956 | Rich | B23B 31/1175 279/2.12 |
| 4,149,682 | A * | 4/1979 | Gustafson | B66C 1/54 242/571.3 |
| 8,075,465 | B2 * | 12/2011 | Verfaellie | D21G 1/0293 492/21 |
| 9,266,317 | B1 * | 2/2016 | Crawford | B44B 5/0071 |
| 2013/0284038 | A1 * | 10/2013 | Rossini | B41F 27/06 101/382.1 |
| 2017/0274640 | A1 * | 9/2017 | Wientjes | B41F 30/00 |

* cited by examiner

*Primary Examiner* — Jill E Culler

(74) *Attorney, Agent, or Firm* — Christopher R. Carroll; The Small Patent Law Group LLC

(57) ABSTRACT

A roller assembly for a heat transfer printing system or hot foil transfer system is provided. The roller assembly includes a cylindrical roller core that extends around a center axis. The roller core includes an exterior surface and an opposite interior surface. The exterior surface is positioned to face a target object being printed upon. The roller assembly also includes a pliable tube in contact with the exterior surface and positioned to contact a thermal print ribbon disposed between the tube and the target object while the roller core is rotated to apply pressure on the ribbon and print onto the target object from the ribbon. The tube is not bonded to the roller core.

13 Claims, 4 Drawing Sheets

ROLLER ASSEMBLY FOR HEAT TRANSFER PRINTING SYSTEM OR HOT STAMP FOIL APPLICATION SYSTEM

CROSS-REFERENCE TO RELATED APPLICATIONS

This application claims priority to U.S. Provisional Application No. 62/610,687, which was filed 27 Dec. 2017, and the entire disclosure of which is incorporated herein by reference.

FIELD

Embodiments of the inventive subject matter described herein relate to roller assemblies that apply pressure to printing ribbons in printing systems such as heat transfer printing systems and/or hot stamp foil application systems.

BACKGROUND

Some printing systems move a ribbon containing a design, a color, and/or foil between a target object and a roller assembly. Heat is generated near the interfaces between the roller assembly, the ribbon, and the target object, and the roller assembly applies pressure on the ribbon (and against the target object). This combination of heat and pressure transfers the design, color, and/or foil to the target object.

The roller assembly can include a pliable body, such as silicone tube, that is chemically bonded to a roller core or hub of the assembly. The core or hub is rotated as the ribbon is moved between the roller assembly and the target object, and the target object is moved or rotated, to transfer the design or color from the ribbon to the target object. The silicone tube of the roller assembly is chemically bonded to the core to prevent the silicone tube from slipping or otherwise moving relative to the core (and at a different speed than the speed at which the ribbon is moved between the roller assembly and the target object). Such slippage of the silicone tube can result in improper transfer of the design, color, and/or foil onto the target object.

One problem with the tube being chemically bonded to the core, however, is that replacement of the tube can be time consuming and expensive. The chemical bonding between the tube and the core prevents the tube from being easily separated from the core. The tube and core may need to be sent to an off-site location for cutting, machining, or tooling of the tube (and the remnants of the tube) off the core. This can require a significant expense in terms of downtime for the core, labor in removing the tube, and shipping the core and tube.

BRIEF DESCRIPTION

In one embodiment, a roller assembly for a heat transfer printing system or a hot foil transfer system is provided. The roller assembly includes a cylindrical roller core that extends around a center axis. The roller core includes an exterior surface and an opposite interior surface. The exterior surface is positioned to face a target object being printed upon. The roller assembly also includes a pliable tube in contact with the exterior surface and positioned to contact a thermal print ribbon disposed between the tube and the target object while the roller core is rotated to apply pressure on the ribbon and print onto the target object from the ribbon. The tube is not bonded to the roller core.

In one embodiment, a method for replacing a pliable first tube from a cylindrical roller core in a roller assembly for a heat transfer printing system or a hot foil transfer system is provided. The method includes detaching a clamping ring from the roller core, removing the first tube from the roller core by sliding the first tube in a direction that is parallel to a center axis of rotation of the roller core, sliding a replacement tube onto the roller core in a direction that is opposite of the direction in which the first tube was removed from the roller core, and attaching the clamping ring to the roller core.

BRIEF DESCRIPTION OF THE DRAWINGS

Reference is now made briefly to the accompanying drawings, in which.

DETAILED DESCRIPTION

One or more embodiments of the inventive subject matter described herein provide a roller assembly for a heat transfer printing system or a hot foil transfer system. The assembly includes a roller core (also referred to as a hub) that is coupled with a pliable tube. The tube can be an elongated tube (e.g., the shape of a long cylinder) or can be a ring. The tube can be formed from silicone or another flexible material. The tube is coupled to the exterior of the roller core without being chemically bonded to the roller core. This enables an easier removal and replacement of the tube without having to send the assembly to another location for machining or cutting the tube off the roller core.

The tube can be a transfer molded tube having a taper on an inside diameter of the tube. This taper allows for the tube to be securely held against the roller core to prevent slippage or other relative movement between the tube and the roller core during heat transfer printing or application of a foil. For example, the tube is securely held against the outside surface or diameter of the roller core so that the tube can be used to apply pressure against a heat transfer ribbon or a foil while the tube and roller core rotate or roll along the ribbon or foil, without the tube slipping relative to the ribbon or foil.

The tube can be easily removed from the roller core without deforming the printing surface of the tube or the roller core. A mandrel encapsulates the tube to allow the tube to be driven with consistent form as the forces of the decoration deflect the flexible material of the tube. The encapsulation of the tube in the mandrel eliminates variations in width of the decoration transferred from the ribbon to a target object by the tube. The spent tubes can be easily removed and disposed of, and then replaced with a new tube, without machining or cutting of the tube off the roller core.

The need for the roller core to be shipped to another location for removal and replacement of the tube is eliminated.

Figure 1:
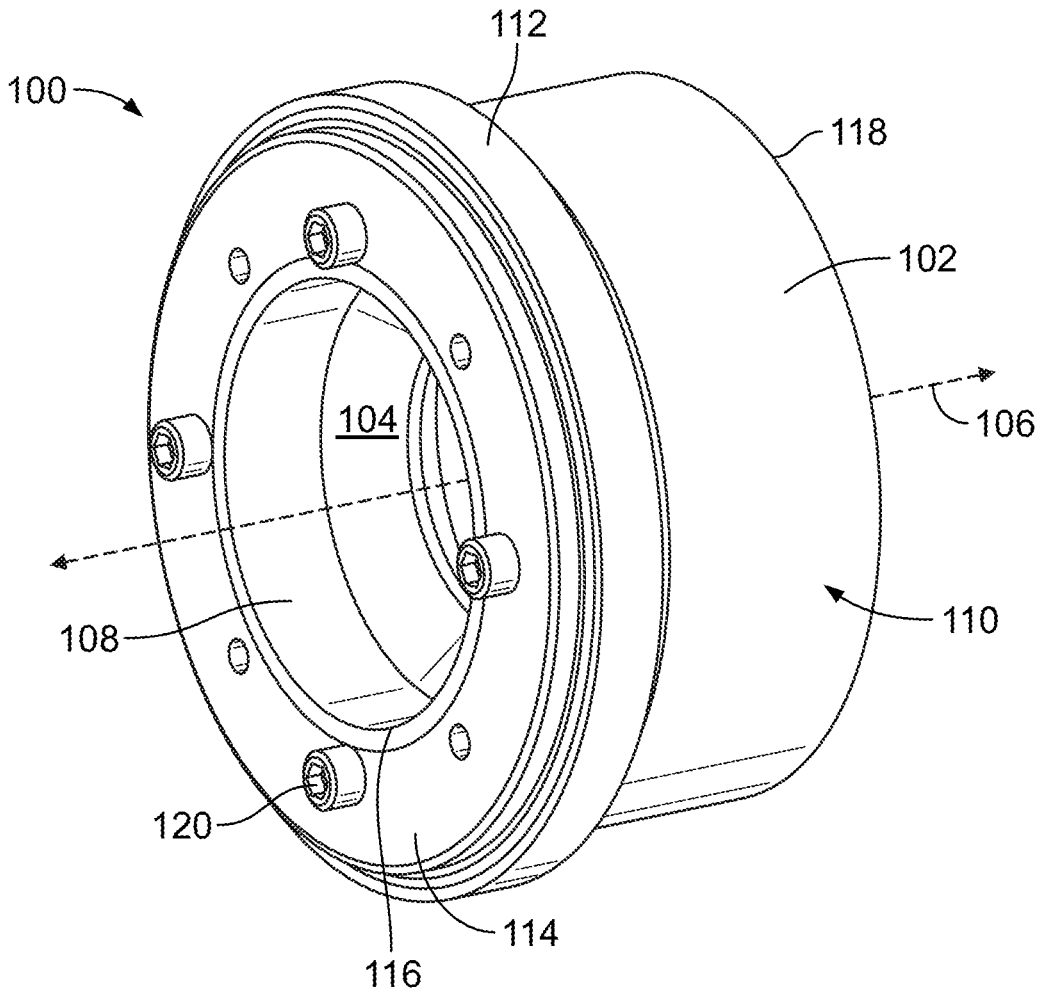
FIG. 1 illustrates a perspective view of a roller assembly for a heat transfer printing system or a hot foil transfer system.
Figure 2:
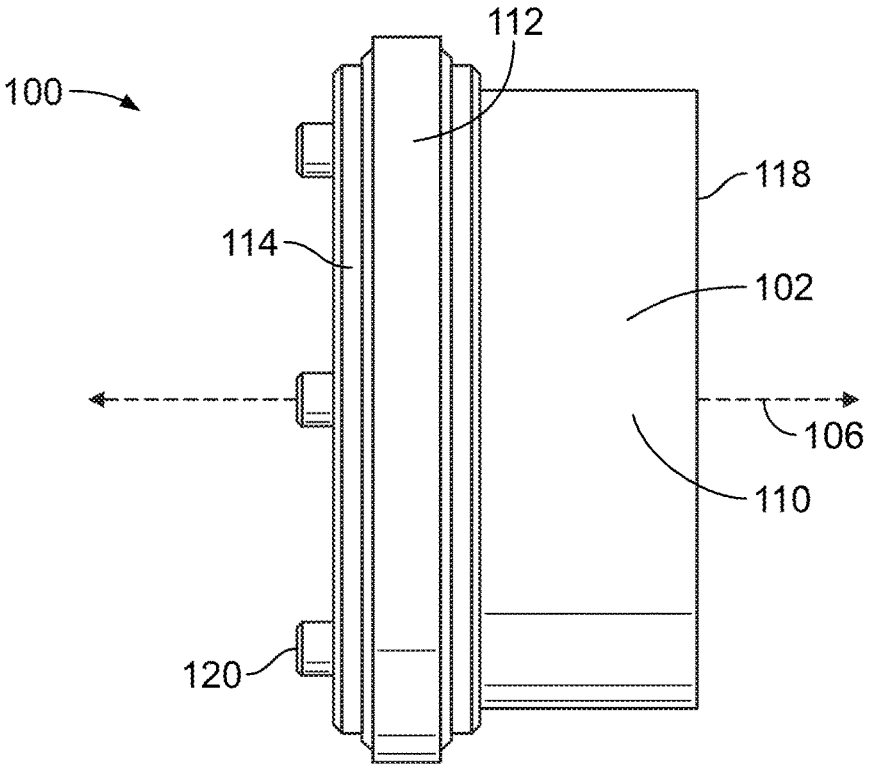
FIG. 2 illustrates a side view of the roller assembly shown in FIG. 1.
Figure 3:
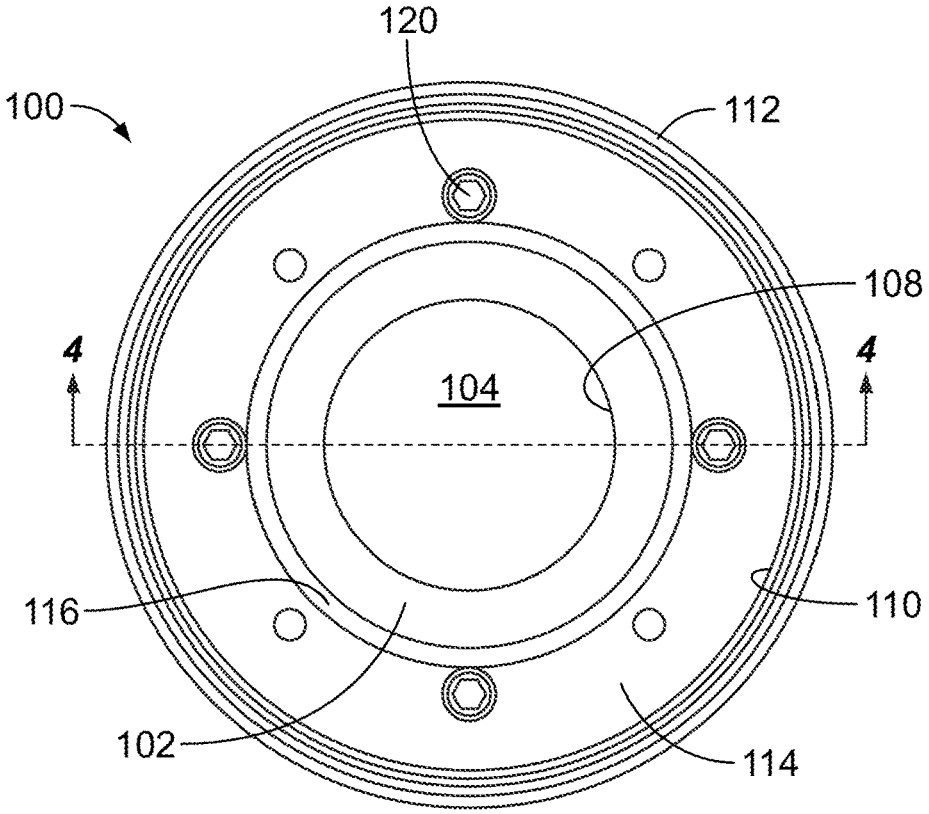
FIG. 3 illustrates a front view of the roller assembly shown in FIG. 1.

FIG. 1 illustrates a perspective view of a roller assembly 100 for a heat transfer printing system or a hot foil transfer system. FIG. 2 illustrates a side view of the roller assembly 100 shown in FIG. 1. FIG. 3 illustrates a front view of the roller assembly 100 shown in FIG. 1. The roller assembly 100 includes a roller core 102, which is a cylindrical body formed from a rigid material. The roller core 102 can be formed from a metal, metal alloy, or a non-metallic material (e.g., ceramic, plastic, or a combination thereof). The roller core 102 includes an interior chamber or opening 104 shaped to be coupled with a mandrel of the heat transfer printing system or hot foil transfer system. This mandrel rotates to rotate the roller core 102 relative to a target object being printed upon.

The body of the roller core 102 encircles a center axis 106. This axis 106 can be the same axis that the roller core 102 rotates around during printing. This body radially extends from an inner rim surface 108 to an outer rim surface 110. The inner rim surface 108 can be referred to as an inner diameter of the roller core 102, and the outer rim surface 110 can be referred to as an outer diameter of the roller core 102. The inner rim surface 108 can be coupled with the mandrel, while at least part of the outer rim surface 110 is coupled with a pliable tube 112. The body of the roller core 102 also axially extends from one end surface 116 to an opposite end surface 118.

The pliable tube 112 can be a silicone tube or ring that also encircles the center axis 106 of the roller core 102. Optionally, the tube 112 can be formed from another material. The tube 112 is formed from a material that is different from, and that is not included in, the material or materials used to form the roller core 102. Additionally, the tube 112 is not chemically bonded with any part of the roller core 102. For example, the tube 112 may not be welded onto the roller core 102, may not be fixed to the roller core 102 by any adhesives, or the like. Instead, the tube 112 may be readily and easily rolled off or otherwise removed from the roller core 102 without damaging or destroying the tube 112, the roller core 102, or anything between the tube 112 and the roller core 102.

The tube 112 can be secured against the outer diameter of the roller core 102 due to geometric features or shapes of the tube 112, due to geometric features or shapes of the roller core 102, and/or due to a clamping ring 114. The clamping ring 114 is a body that can be formed from the same or different material(s) as the roller core 102. The clamping ring 114 is secured to the end surface 116 of the roller core 102. The clamping ring 114 is shown as being fixed to the roller core 102 by several fasteners 120 (e.g., screws, bolts, etc.), but optionally can be coupled through a friction fit connection, snap fit connection, or other connection.

Figure 4:
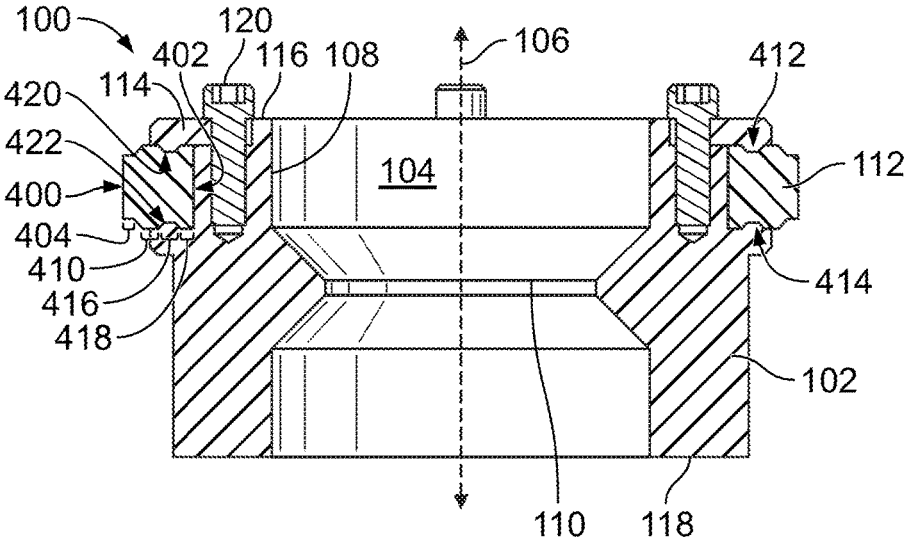
FIG. 4 illustrates one embodiment of a cross-sectional view of the roller assembly along line A-A shown in FIG. 3.
Figure 5:
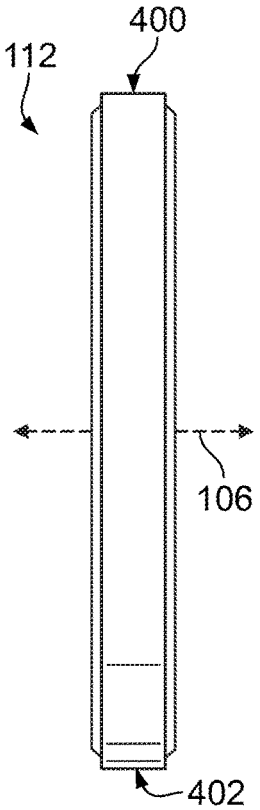
FIG. 5 illustrates a side view of a tube shown in FIG. 1 according to one embodiment.
Figure 6:
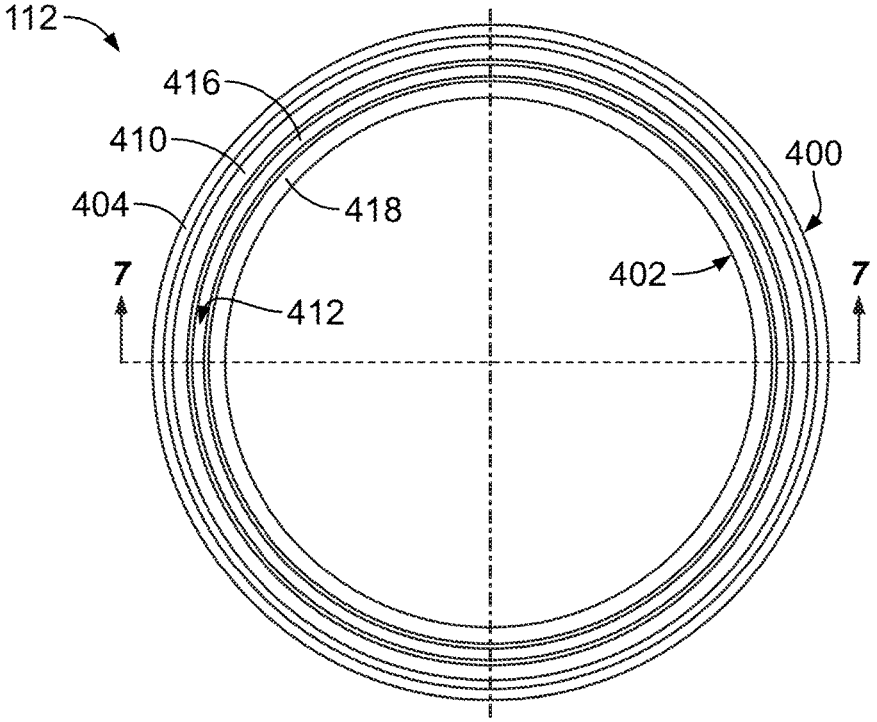
FIG. 6 illustrates a top view of the tube shown in FIG. 5.
Figure 7:
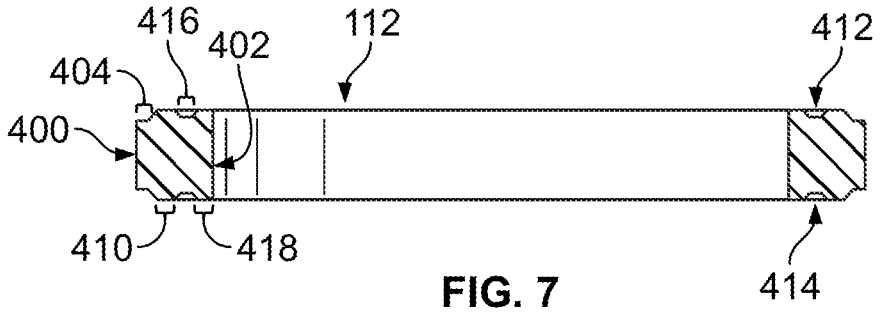
FIG. 7 illustrates a cross-sectional view of the tube along line A-A shown in FIG. 6.

FIG. 4 illustrates one embodiment of a cross-sectional view of the roller assembly 100 along line A-A shown in FIG. 3. FIG. 5 illustrates a side view of the tube 112 according to one embodiment. FIG. 6 illustrates a top view of the tube 112 shown in FIG. 5. FIG. 7 illustrates a cross-sectional view of the tube 112 along line A-A shown in FIG. 6.

The tube 112 has a tapered shape that changes in cross-sectional area at different radii from the center axis 106. The tube 112 is staged in thickness from an outer contact surface 400 to an inner contact surface 402. The thickness of the tube 112 is measured along directions that are parallel to the center axis 106 (e.g., up and down in the perspective of FIG. 4).

The outer contact surface 400 engages the thermal print ribbon during printing on a target object. A first stage 404 of the tube 112 includes the outer contact surface 400, and has a thickness that is constant or approximately constant (e.g., within manufacturing tolerances, or does not change more than 3% or 5%) throughout the radii in the first stage 404.

The thickness of the tube 112 increases from the first stage 404 to a larger thickness in a second stage 410. The second stage 410 of the tube 112 forms one side of opposite grooves 412, 414 in the tube 112. A third stage 416 of the tube 112 forms the interiors of the grooves 412, 414, and has a reduced thickness relative to the second stage 410 and a fourth stage 418. The fourth stage 418 forms the opposite side of the grooves 412, 414 (from the second stage 410), and has a greater thickness than the third stage 416.

The clamping ring 114 and the body of the roller core 102 include opposing protrusions 420, 422 that extend toward each other and into the grooves 412, 414 in the tube 112. With the clamping ring 114 removed, the tube 112 can be placed onto the body of the roller core 102 (in a downward direction in FIG. 4) until the lower groove 414 engages the lower protrusion 422 of the body of the roller core 102 (and the lower protrusion 422 is received into the lower groove 414. The clamping ring 114 can then be placed onto the tube 112 so that the tube 112 is disposed between the body of the roller core 102 and the clamping ring 114 in directions that are parallel to the center axis 106. The upper protrusion 420 of the clamping ring 114 is received into the upper groove 412 of the tube 112. The fasteners 120 can then be inserted through the clamping ring 114 and into the body of the roller core 102 to clamp down on the tube 112 and secure the tube 112.

During operation, engagement of the protrusions 420, 422 in the tapered portion of the tube 112 (e.g., the grooves 412, 414) holds the tube 112 in place and prevents the tube 112 from slipping or otherwise moving relative to the roller core 102. Additionally, the tube 112 may increase in size due to thermal expansion and the application of heat during the printing. This increase in size also provides for a secure coupling between the tube 112 and the roller core 102. The tube 112 is securely held in place without the use of chemical bonds or adhesives between the tube 112 and the roller core 102 during thermal printing. When the tube 112 needs to be replaced (e.g., due to deterioration of the tube 112), the fasteners 120 can be removed and the clamping ring 114 lifted off the roller core 102. The old tube 112 can be simply slid off the roller core 102, and a replacement tube 112 can be simply slid onto the roller core 102 and secured using the clamping ring 114, as described above. The old and replacement tubes 112 can be slid off or onto the roller core 102 in directions that are parallel to the axial direction 106 because the tubes 112 are not bonded to the roller core 102.

Figure 8:
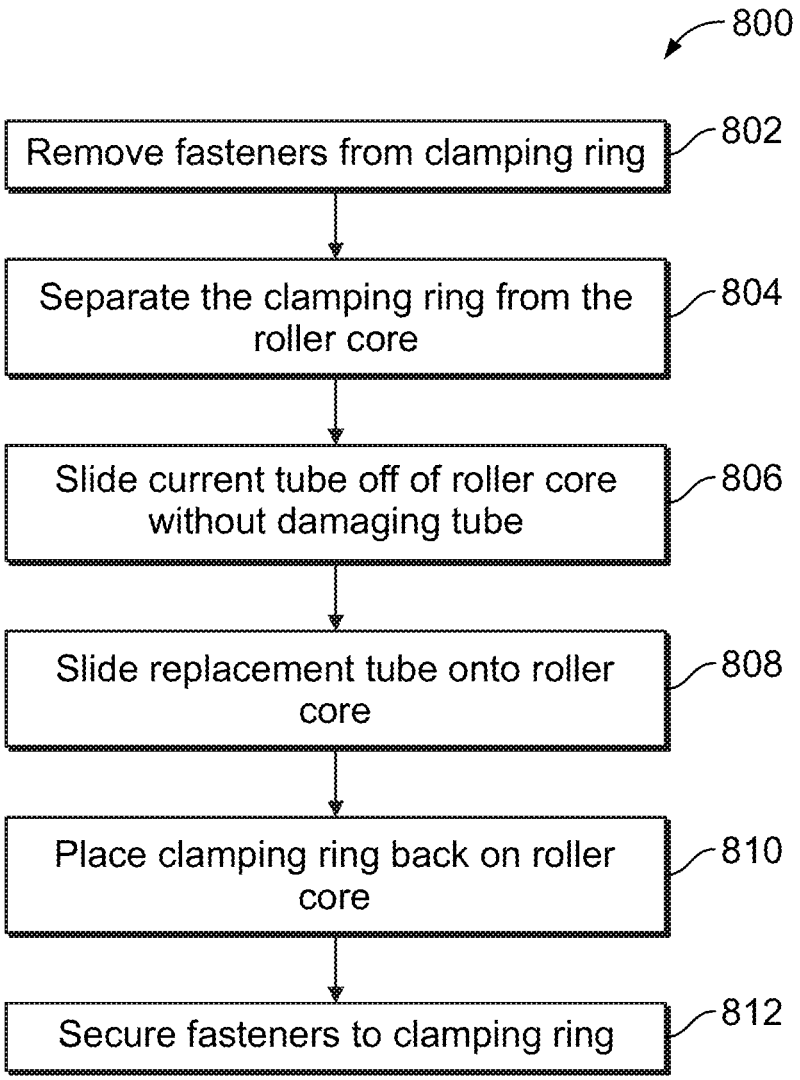
FIG. 8 illustrates a flowchart of one embodiment of a method for replacing an exterior tube of a roller core in a thermal printing system.

FIG. 8 illustrates a flowchart of one embodiment of a method 800 for replacing an exterior tube of a roller core in a thermal printing system. The method 800 can be used to replace the tube 112 on the roller core 102 for the assembly 100. At 802, the fasteners 120 holding the clamping ring 114 onto the roller core 102 are removed. At 804, the clamping ring 114 is removed, separated, or loosened from the roller core 102. At 806, the tube 112 currently around the body of the roller core 102 is slid off the body of the roller core 102 in a direction that is parallel to the center axis 106 of the roller core 102. The tube 112 can be removed from the roller core 102 without breaking any bonds between the tube 112 and the body of the roller core 102, without tearing or cutting any part of the tube 112, without removing (e.g., dissolving) or cutting through any adhesive between the tube 112 and the body of the roller core 102, or the like. At 808, a replacement tube 112 is slid onto the body of the roller core 102 in a direction that is parallel to the center axis 106 and that is opposite of the direction in which the previous tube 112 was removed. At 810, the clamping ring 114 is placed onto the tube 112. At 812, the fasteners 120 are secured to hold the clamping ring 114 onto the body of the roller core 102 with the tube 112 disposed between the clamping ring 114 and the roller core 102 in directions that are parallel to the center axis 106.

In one embodiment, a roller assembly for a heat transfer printing system or hot foil transfer system is provided. The roller assembly includes a cylindrical roller core that extends around a center axis. The roller core includes an exterior surface and an opposite interior surface. The exterior surface is positioned to face a target object being printed upon. The roller assembly also includes a pliable tube in contact with the exterior surface and positioned to contact a thermal print ribbon disposed between the tube and the target object while the roller core is rotated to apply pressure on the ribbon and print onto the target object from the ribbon. The tube is not bonded to the roller core.

Optionally, the tube can be slid off the roller core in a direction that is parallel to the center axis.

Optionally, the tube is not chemically bonded with the roller core.

Optionally, the tube is not secured to the roller core using any adhesive between the tube and the roller core.

Optionally, the tube is not secured to the roller core using any material between the tube and the roller core.

Optionally, the roller core extends from a first end to an opposite second end in directions that are parallel to the center axis. The assembly also can include a clamping ring that attaches to the first end of the roller core with the tube disposed between the clamping ring and the first end of the roller core in the directions that are parallel to the center axis.

Optionally, the clamping ring includes an upper protrusion that outwardly extends from the clamping ring in the directions that are parallel to the center axis.

Optionally, the upper protrusion of the clamping ring extends around and encircles the center axis.

Optionally, the tube includes an upper groove that faces the clamping ring and that receives the upper protrusion of the clamping ring.

Optionally, the roller core includes a lower protrusion that outwardly extends from the clamping ring in the directions that are parallel to the center axis.

Optionally, the lower protrusion of the roller core extends around and encircles the center axis.

Optionally, the tube includes a lower groove that receives the lower protrusion of the roller core.

Optionally, the assembly includes a clamping ring that attaches to the roller core with the tube disposed between the clamping ring and the roller core in the directions that are parallel to the center axis. The clamping ring can include an upper protrusion that outwardly extends from the clamping ring in the directions that are parallel to the center axis. The roller core includes a lower protrusion that outwardly extends from the clamping ring in the directions that are parallel to the center axis, the upper protrusion extending from the clamping ring toward the lower protrusion of the roller core. The lower protrusion of the roller core can extend from the roller core toward the upper protrusion of the clamping ring. The tube can include upper and lower grooves on opposite sides of the tube, where the upper grove receives the upper protrusion of the clamping ring and the lower groove receives the lower protrusion of the roller core.

In one embodiment, a method for replacing a pliable first tube from a cylindrical roller core in a roller assembly for a heat transfer printing system or hot foil transfer system is provided. The method includes detaching a clamping ring from the roller core, removing the first tube from the roller core by sliding the first tube in a direction that is parallel to a center axis of rotation of the roller core, sliding a replacement tube onto the roller core in a direction that is opposite of the direction in which the first tube was removed from the roller core, and attaching the clamping ring to the roller core.

Optionally, the first tube is removed from the roller core without damaging the first tube.

Optionally, the first tube is removed from the roller core without cutting the first tube.

Optionally, the first tube is removed from the roller core without removing an adhesive between the roller core and the first tube.

Optionally, the first tube is removed from the roller core without removing any material between the roller core and the first tube.

Optionally, the replacement tube is coupled to the roller core by the clamping tube without chemically bonding the replacement tube with the roller core.

Optionally, the replacement tube is coupled to the roller core by the clamping tube without adhering the replacement tube with the roller core using any adhesive.

Optionally, the replacement tube is coupled to the roller core by the clamping tube without any material being between the replacement tube and the roller core.

Optionally, the replacement tube is slid onto the roller core by placing a lower groove in the replacement tube onto a lower protrusion of the roller core.

Optionally, the clamping tube is attached to the roller core by placing an upper protrusion of the clamping tube into an upper groove in the replacement tube.

Optionally, the replacement tube is slid onto the roller core by placing a lower groove in the replacement tube onto a lower protrusion of the roller core. The clamping tube can be attached to the roller core by placing an upper protrusion of the clamping tube into an upper groove in the replacement tube.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein are intended to define the parameters of the inventive subject matter, they are by no means limiting and are example embodiments. Many other embodiments will be apparent to one of ordinary skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose several embodiments of the inventive subject matter and also to enable one of ordinary skill in the art to practice the embodiments of inventive subject matter, including making and using any devices or systems and performing any incorporated methods. The patentable scope of the inventive subject matter is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

As used herein, an element or step recited in the singular and proceeded with the word "a" or "an" should be understood as not excluding plural of said elements or steps, unless such exclusion is explicitly stated. Furthermore, references to "one embodiment" of the present inventive subject matter are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

What is claimed is:

1. A roller assembly for a heat transfer printing system or hot foil transfer system, the roller assembly comprising:

a cylindrical roller core that extends around a center axis, the roller core including an exterior surface and an opposite inner surface, the exterior surface positioned to face a target object being printed upon;

a clamping ring configured to be coupled with the roller core, the roller core including a first protrusion extending in a first direction and the clamping ring including a second protrusion extending in an opposite second direction with the first and second protrusions opposing each other and axially extending toward each other in the first and second directions that are parallel to the center axis of the roller core; and a pliable tube in contact with the exterior surface and positioned to contact a thermal print ribbon disposed between the tube and the target object while the roller core is rotated around the center axis to apply pressure on a ribbon and print onto the target object from the ribbon, the tube including first and second grooves on opposite sides of the tube, the first groove extending into the tube along the first direction and the second groove extending into the tube along the second direction, the first groove of the tube positioned to receive the first protrusion of the roller core, the second groove of the tube positioned to receive the second protrusion of the clamping ring, wherein the tube is not bonded to the roller core.

2. The roller assembly of claim 1, wherein the tube can be slid off the roller core in the first direction that is parallel to the center axis.

3. The roller assembly of claim 1, wherein the tube is not chemically bonded with the roller core.

4. The roller assembly of claim 1, wherein the tube is not secured to the roller core using any adhesive between the tube and the roller core.

5. The roller assembly of claim 1, wherein the tube is not secured to the roller core using any material between the tube and the roller core.

6. The roller assembly of claim 1, wherein the roller core extends from a first end to an opposite second end in the second direction, and wherein the clamping ring attaches to the first end of the roller core with the tube disposed between the clamping ring and the first end of the roller core in the first and second directions that are parallel to the center axis.

7. A method for replacing a pliable first tube from a cylindrical roller core in a roller assembly for a heat transfer printing system or hot foil transfer system, the method comprising:

detaching a clamping ring from the roller core such that a first protrusion axially extending away from the clamping ring in a first direction that is parallel to a center axis of rotation of the roller core is removed from a first groove axially extending into the first tube in the first direction;

removing the first tube from the roller core by sliding the first tube in a second direction that is parallel to the center axis of rotation of the roller core and that is opposite the first direction such that a second groove in the first tube is removed from a second protrusion axially extending away from the roller core in the second direction;

sliding a replacement tube onto the roller core in the first direction, the replacement tube sliding onto the roller core by placing a third groove that axially extends into the replacement tube in the second direction onto the second protrusion of the roller core; and attaching the clamping ring to the roller core by placing the first protrusion of the clamping ring into a fourth groove that axially extends into the replacement tube in the first direction.

8. The method of claim 7, wherein the first tube is removed from the roller core without damaging the first tube.

9. The method of claim 7, wherein the first tube is removed from the roller core without cutting the first tube.

10. The method of claim 7, wherein the first tube is removed from the roller core without removing any material between the roller core and the first tube.

11. The method of claim 7, wherein the replacement tube is coupled to the roller core by the clamping ring without chemically bonding the replacement tube with the roller core.

12. A roller assembly for a heat transfer printing system or hot foil transfer system, the roller assembly comprising:

a cylindrical roller core that extends around a center axis, the roller core including an exterior surface and an opposite interior surface, the exterior surface positioned to face a target object being printed upon, the roller core including a first protrusion that axially extends away from the roller core in a first direction that is parallel to the center axis, wherein the exterior surface of the roller core is shaped to receive a pliable tube by placing a first groove axially extending into the tube along the first direction onto the first protrusion of the roller core without the roller core being bonded to the tube such that the tube is positioned to contact a thermal print ribbon disposed between the tube and the target object while the roller core is rotated to apply pressure on the ribbon and print onto the target object from the ribbon; and a clamping ring having a second protrusion that axially extends from the clamping ring in a second direction that is parallel to the center axis of the roller core, the clamping ring configured to attach to the roller core with the second protrusion received into a second groove of the tube that axially extends into the tube in the second direction such that the tube is disposed between the clamping ring and the roller core with the first and second protrusions extending toward each other.

13. The roller assembly of claim 12, wherein the roller core extends from a first end to an opposite second end along the center axis, and wherein the clamping ring attaches to the first end of the roller core.

* * * * *